US005178569A

United States Patent [19]

Wang

[11] Patent Number: 5,178,569

[45] Date of Patent: Jan. 12, 1993

[54] AUTO-INFLATED LIFE BUOY

[75] Inventor: Sung-Shun Wang, Tainan Hsien, Taiwan

[73] Assignee: San Ying Industrial Co. Ltd., Tainan Hsien, Taiwan

[21] Appl. No.: 741,599

[22] Filed: Aug. 7, 1991

[51] Int. Cl.[5] ..... B63C 9/125; B63C 9/15; B63C 9/08

[52] U.S. Cl. ..... 441/93; 441/106; 441/94; 441/88

[58] Field of Search ..... 441/106, 108, 122, 113, 441/123, 92, 93, 94

[56] References Cited

U.S. PATENT DOCUMENTS

| | | | |
|---|---|---|---|
| 3,046,575 | 7/1962 | Davis et al. | 441/93 |
| 5,037,341 | 8/1991 | Howard | 441/106 |

FOREIGN PATENT DOCUMENTS

| | | | |
|---|---|---|---|
| 511486 | 4/1955 | Canada | 441/94 |
| 1466562 | 3/1977 | United Kingdom | 441/94 |

*Primary Examiner*—Joseph F. Peters, Jr.
*Assistant Examiner*—Kenneth Lee
*Attorney, Agent, or Firm*—Morton J. Rosenberg; David I. Klein

[57] ABSTRACT

An auto-inflated life buoy has a belt-like air bag and an air container. The belt-like air bag defines a hollow bag, and has tongue secured on the inside wall of one end and a groove secured on the inside wall of the other end. The air container secured on the outside wall of one end of the belt-like air bag includes an air inlet, an internal chamber and an inlet nozzle. The air inlet coupled to the belt-like air bag is in open communication with the internal chamber which has a press button on the top and a film on the bottom. The lower part of the press button is combined with a pressure spring. The improvement of the auto-inflated life buoy is that after a swimmer fastens the belt-like air bag on the waist by mounting the tongue to the groove and by attaching the back of the air container to the outside wall of the other end of the belt-like air bag with a set of blind fastener, the swimmer may push down the press button so that the lower part of the press button will break the film and the air container will immediate inflate the belt-like air bag with sufficient air through the air inlet.

1 Claim, 3 Drawing Sheets

AUTO-INFLATED LIFE BUOY

BACKGROUND OF THE INVENTION

1. Field of the Invention

The subject auto-inflated life buoy invention concept relates to a life buoy to be worn on the waist of a swimmer which is capable of being automatically inflated by the swimmer in an efficient manner when the swimmer or user finds himself or herself in a distressed condition while in the water. The subject invention further directs itself to an auto-inflated life buoy where the user may mount a belt-like air bag container around his or her waist in a secure manner and includes adjustment mechanisms for differing waist circumferences. Still further, this invention relates to a belt-like air bag system which includes releasable fasteners mounted on an outer wall of the air bag to allow increased circumferential extension of the air bag subsequent to insert of pressurized air within the bag responsive to actuation a user. Still further, this invention directs itself to an auto-inflatable life buoy system where the user only has to press a button to efficiently inflate an air bag surrounding the waist of the user.

2. Prior Art

Life buoys are known in the art and have been used to provide flotation devices for swimmers that are distressed in the water. However, such prior art life buoys are generally inconvenient and in some cases are maintained in the inflated condition thus not providing the user with the capability of free movement of his or her body members during the time they are swimming. Other prior art life buoys which are inflatable at the discretion of the user are generally inefficient in their actuation mechanisms and do not provide a time saving operation which may be critical when a user is in a distressed condition in the water. Still further, other prior art life buoy systems do not permit adjustability of the circumferential length of the life buoy when passed around the body of the user. Still other prior art life buoy systems do not provide for automatically releasable fasteners which are released subsequent to air inflation to allow the life buoy to pass from the waist of the user under the armpits of the user.

SUMMARY OF THE INVENTION

An auto-inflated life buoy is provided which includes a belt-like air bag defining an air inflatable chamber. The air bag has an inner wall located adjacent the body of a user and an opposing outer wall. The air bag has an extended length providing closed ends positionally located adjacent each other when the belt-like air bag is mounted on the user's body. A tongue in groove fastening mechanism is secured to the opposing closed ends of the air bag and the inner wall for releasably securing the closed ends each to the other. A pressurized air container defining a container chamber and having an inlet nozzle for insertion and removal of pressurized air to and from the pressurized air container chamber is provided. The air container has an internal chamber in fluid communication with the interior of one of the ends of the air bag and the internal chamber is separated from the container chamber by a puncturable film layer. A spring biased displaceable button member is mounted on a wall of the pressurized air container having a lower end for puncturing the film layer when the user pushes the button wherein pressurized air exits the container chamber, passes through the internal chamber and inflates the belt-like bag. The pressurized container is releasably secured to the outer wall of the air bag on one end thereof by an extended releasable fastener to provide circumferential adjustment when the air bag is mounted on the body of the user.

It is a primary object of the present invention to provide an automatically inflatable life buoy having an air container coupled to one end of the belt-like air bag so as to inflate the air bag with sufficient air when the swimmer presses a button of the air container during an emergency when the user is in a distressed condition in the water.

It is a further object of the subject invention to provide an automatically inflatable life buoy which is capable of easily being operated by the swimmer in an emergency condition.

It is a still further object of the subject invention to provide an automatic life buoy capable of being fastened on the waist of the swimmer and which may be collapsed for easy storage.

DESCRIPTION OF THE PREFERRED EMBODIMENTS

Figure 1:
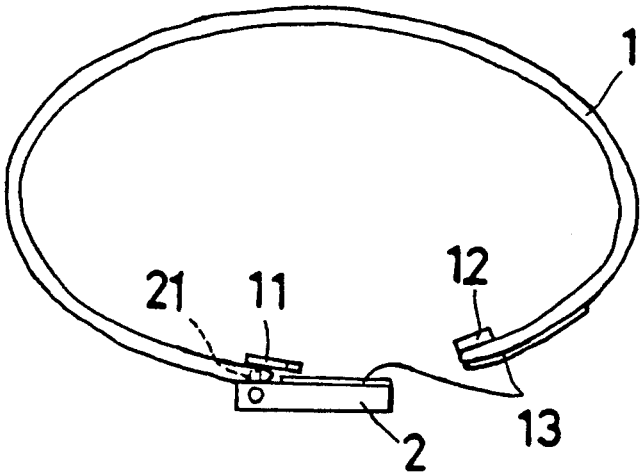
FIG. 1 is a top plan view of the subject auto-inflated life buoy.
Figure 2:
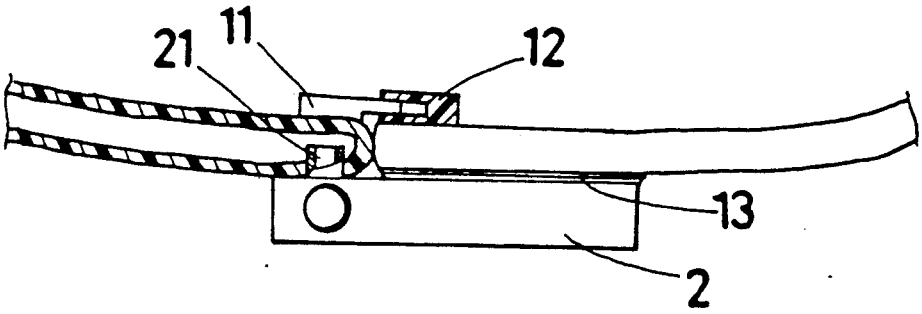
FIG. 2 is a top plan view partially cutaway showing the belt-like air bag of the subject invention fastened by a tongue in groove fastener.
Figure 3:
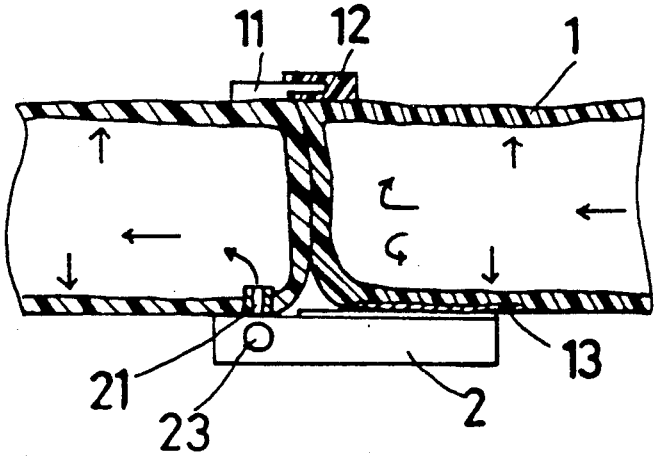
FIG. 3 is a top plan partially cutaway view showing the belt-like air bag of the present invention in an inflated condition.
Figure 5:
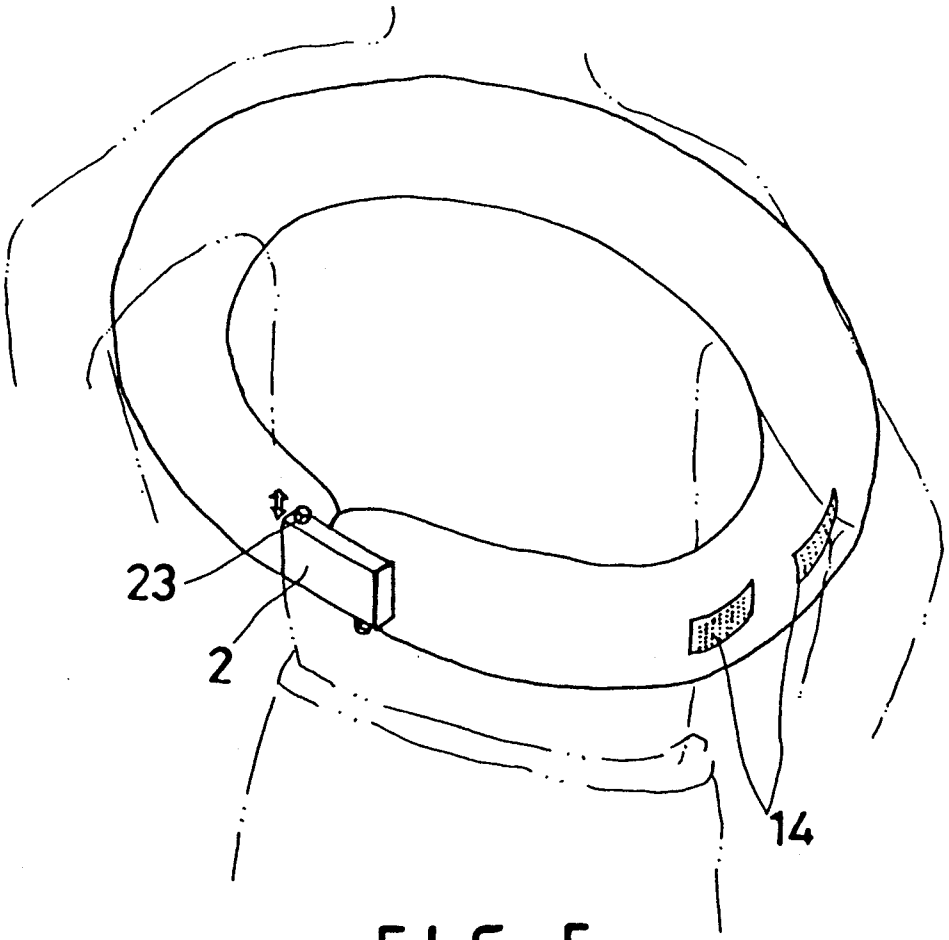
Figure 4:
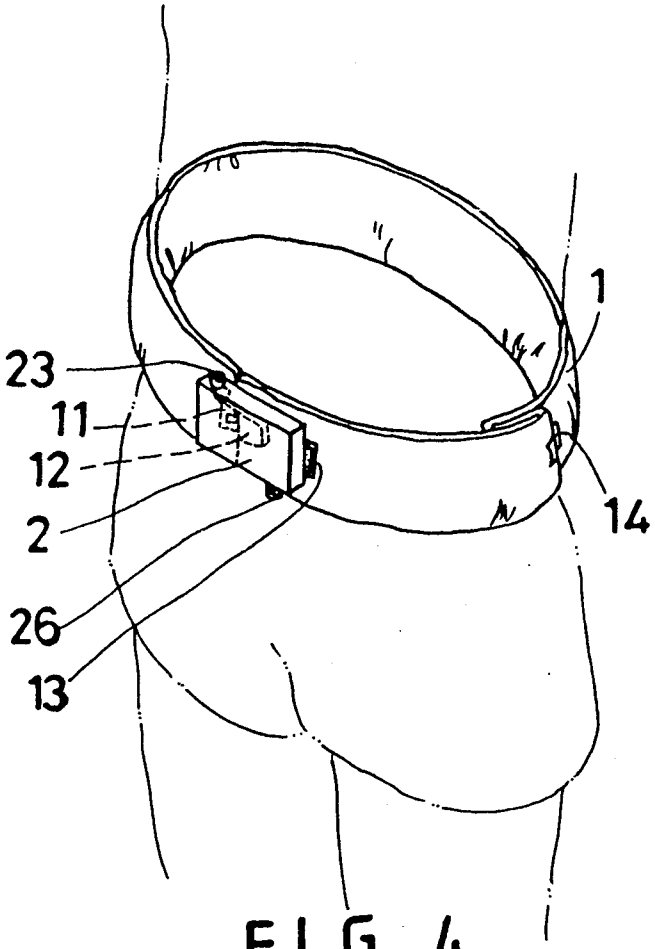
FIG. 4 is a perspective view of the belt-like air bag mounted around the waist of a user; and, FIG. 5 is a perspective view showing the belt-like air bag of the user subsequent to inflation and mounted under the arms of a user.

Referring now to FIGS. 1–5, there is shown the auto-inflated life buoy of the subject invention concept having a belt-like air bag 1 and a pressurized air container 2. The belt-like air bag 1 defines an air inflatable chamber formed of a resilient and air impervious material. The air bag 1 has an inner wall located adjacent the body of the user as is seen in FIG. 4 and includes an outer wall which opposes the inner wall and is distal from the body of the user. The air bag 1 has an extended length with closed ends as shown clearly in FIGS. 2 and 3 where the closed ends are positionally located adjacent each other when the belt-like air bag 1 is mounted on the user's body.

Figure 2A:
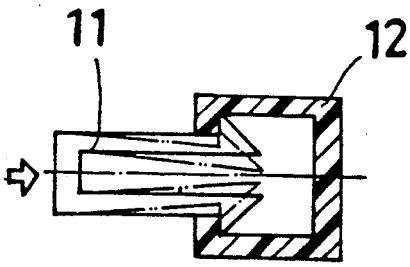
FIG. 2A is a side view showing the tongue in groove fastener in the fastening condition as provided in FIG. 2.

A tongue in groove mechanism 11, 12 is shown clearly in FIG. 2A where there is a tongue member 11 secured on the inner wall of one end of the belt-like air bag 1 as shown in FIG. 2. A groove mechanism 12 is secured on the inner wall of the other end of the belt-like air bag 1 as is shown. The tongue member is transversely displaceable and has an arrow contour end for insert and capturing of the tongue member 11 within the groove member 12.

The pressurized air container 2 defines a container chamber and is mounted on the outer wall of one end of the belt-like air bag 1. The pressurized air container 2 is releasably attachable to the outside wall of the other end of the belt-like air bag with a set of blind fasteners 13 which may be extended Velcro strips as shown in FIGS. 2 and 3.

The pressurized air container 2 has an internal chamber in fluid communication with the interior of one of the ends of the air bag 1 through the internal chamber 22 and the conduit 21 as is shown. The conduit 21 is coupled to the belt-like air bag 1 and is in open communication with the internal chamber 22. The internal chamber 22 has a spring-biased button 23 mounted on a top wall of the pressurized air container 2.

Figure 2B:
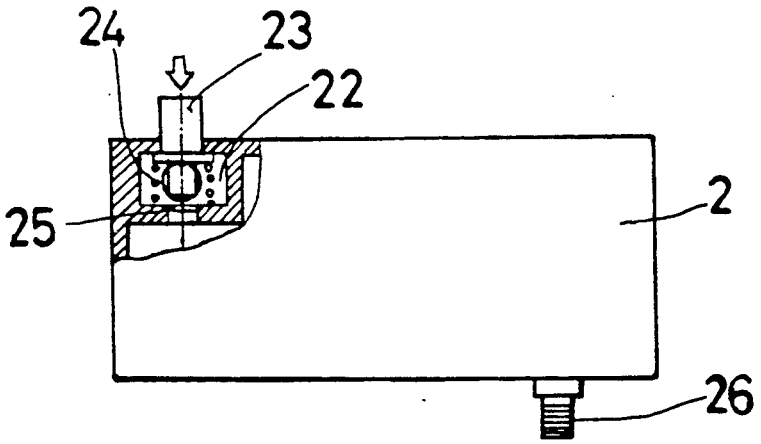
FIG. 2B is a side view partially cutaway of the pressurized air container of the subject invention.
Figure 2C:
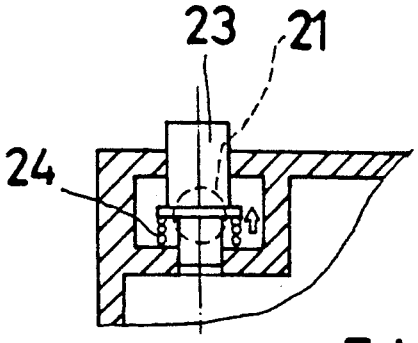
FIG. 2C is a sectional view showing the air inflation device of the air container having a spring bias button for breaking a film layer.

A film layer 25 as shown in FIG. 2B is provided at the bottom of the internal chamber 22 and separates the internal chamber 22 from the container chamber containing the pressurized gas.

The lower end of the button member 23 is combined with the helical spring 24 and the button 23 is biased in an upwardly directed displacement as shown in FIG. 2B.

When the user pushes the button 23 in a downward displacement, the lower portion of the button 23 will fracture the film 25 so that the pressurized air within the air container 2 will pass through the internal chamber 22 and into the interior of the air bag 1 as is seen in FIG. 3.

The pressurized air container 2 includes the inlet nozzle 26 mounted on the bottom of the air container 2 as shown in FIG. 2B. The inlet nozzle 26 allows for insertion and removal of pressurized air to and from the pressurized air container chamber.

The inlet nozzle 26 is of standard construction assembly and may allow pressurized air to be removed from pressurized air container 2 by the insertion of an ejector pin.

In operation, the auto-inflated life buoy of the present invention as is shown in FIG. 4 is initially adjusted by the swimmer through mounting of the container 2 by the releasable fasteners 13 and further by the Velcro-like releasable fasteners 14 to provide a snug fit. As seen in FIG. 4, air bag 1 may be folded upon itself to provide varying circumferential extensions. The air bag 1 is mounted on the waist of the user by mounting the tongue 11 within the groove member 12 and by attaching the air container 2 to the outside wall of the other end of the belt-like air bag 1 with the fastening mechanism 13 as shown in FIGS. 1, 2, 2A and 4.

When the swimmer or user finds himself or herself in distress in the water, he or she may press the button 23 displaceably mounted on the air container 2 so that the lower portion of the button 23 will fracture the film 25. The pressurized air within the air container 2 passes through the internal chamber 22 into the air bag and such is inflated with sufficient air to provide flotation.

Subsequent to use or when not in operation, the air inflated belt-like air bag 1 may be depressurized by using an ejector pin for insert into the insert nozzle 26 to allow air to egress from the air container 2. In this manner, the empty belt-like air bag 1 may be folded into a small volume for easy transportability.

While the preferred embodiments of the invention have been described above, it will be recognized and understood that various modifications may be made therein and the appended claims are intended to cover such modifications which may fall within the spirit and scope of the invention.

What is claimed is:

1. An auto-inflated life buoy comprising:

(a) a belt-like air bag defining an air inflatable chamber, said air bag having an inner wall located adjacent the body of a user and an opposing outer wall, said air bag having an extended length providing closed ends positionally located adjacent each other when said belt-like air bag is mounted on said user's body;

(b) tongue in groove fastening means secured to said opposing closed ends and said inner wall for releasably securing said closed ends each to the other;

(c) a pressurized air container defining a container chamber and having an inlet nozzle for insertion and removal of pressurized air to and from said pressurized air container chamber, said air container having an internal chamber in fluid communication with the interior of one of said ends of said air bag, said internal chamber being separated from said container chamber by a puncturable film layer;

(d) a spring biased displaceable button member mounted on a wall of said pressurized air container having a lower end for puncturing said film layer when said user pushes said button wherein pressurized air exits said container chamber, passes through said internal chamber and inflates said belt-like bag, said pressurized container being releasably secured to said outer wall of said air bag on one end thereof by an extended releasable fastener to provide circumferential adjustment when said air bag is mounted on said body of said user; and, (e) a plurality of releasable securement elements mounted on said outer wall of said air bag to allow (1) said air bag to be folded upon itself for positional placement around the waist of said user and, (2) said air bag to be increased in circumferential length for mounting of said air bag under the arms of said user.

* * * * *